US008826602B1

(12) United States Patent
Lipscomb

(10) Patent No.: US 8,826,602 B1
(45) Date of Patent: Sep. 9, 2014

(54) WEB OR SUPPORT STRUCTURE AND METHOD FOR MAKING THE SAME

(71) Applicant: Stephen L. Lipscomb, Spotsylvania, VA (US)

(72) Inventor: Stephen L. Lipscomb, Spotsylvania, VA (US)

(73) Assignees: Stephen L. Lipscomb, Spotsylvania, VA (US); Patrecia A. Lipscomb, Spotsylvania, VA (US)

( * ) Notice: Subject to any disclaimer, the term of this patent is extended or adjusted under 35 U.S.C. 154(b) by 0 days.

(21) Appl. No.: 14/097,525

(22) Filed: Dec. 5, 2013

(51) Int. Cl.
*E04B 7/10* (2006.01)
*E04B 1/02* (2006.01)

(52) U.S. Cl.
CPC ..... *E04B 1/02* (2013.01)
USPC ..... 52/80.2; 52/648.1

(58) Field of Classification Search
USPC ..... 52/648.1, 80.1, 80.2, 81.1–81.6
See application file for complete search history.

(56) References Cited

U.S. PATENT DOCUMENTS

| | | | | | |
|---|---|---|---|---|---|
| 4,207,715 | A * | 6/1980 | Kitrick | 52/81.4 |
| 4,492,723 | A * | 1/1985 | Chadwick, II | 428/7 |
| 4,719,726 | A * | 1/1988 | Bergman | 52/81.4 |
| 5,036,635 | A * | 8/1991 | Lalvani | 52/80.1 |
| 5,155,951 | A * | 10/1992 | Lalvani | 52/80.2 |
| 5,168,677 | A * | 12/1992 | Pronsato et al. | 52/81.1 |
| 5,265,395 | A * | 11/1993 | Lalvani | 52/648.1 |
| 5,505,035 | A * | 4/1996 | Lalvani | 52/648.1 |
| 5,524,396 | A * | 6/1996 | Lalvani | 52/81.1 |
| 5,623,790 | A * | 4/1997 | Lalvani | 52/81.2 |
| 6,931,812 | B1 | 8/2005 | Lipscomb | |
| 8,286,392 | B2 * | 10/2012 | Noble et al. | 52/79.4 |
| 2008/0040984 | A1 * | 2/2008 | Lanahan | 52/79.9 |
| 2010/0218437 | A1 * | 9/2010 | Newland | 52/80.2 |

OTHER PUBLICATIONS

S.L. Lipscomb, *Compression and Core Geometry of Two Panels*, Unpublished, Jul. 9, 2005 (5 pages).

S.L. Lipscomb, *Fractals and Universal Spaces in Dimension Theory*, Springer Monographs in Mathematics, 2009, Chapter 2 "Self-Similarity and $J_n$+1 for Finite n" pp. 11-22 (14 pages).

J. Perry and S. Lipscomb, *The generalization of Sierpinski's Triangle That Lives in 4-space*, Houston Journal of Mathematics, vol. 29, No. 3, 2003, pp. 691-710.

Greenberg, Marvin J. "Euclidean and Non-Euclidean Geometries" Chapter 7 "Independence of the Parallel Postulate", pp. 177-236. Development and History (Second Edition). Published by W.H. Freeman and Company, San Francisco. Copyright 1972 by Marvin Jay Greenberg and Copyright 1974, 1980 by W.H. Freeman and Company (33 pages).

* cited by examiner

*Primary Examiner* — William Gilbert
*Assistant Examiner* — Gisele Ford
(74) *Attorney, Agent, or Firm* — Dinesh Agarwal, P.C.

(57) ABSTRACT

A web structure including a generally octahedron-shaped frame having a first set of a plurality of points oriented in a first plane, and a second set of a plurality of points oriented in a second plane generally parallel to the first plane. The first and second sets of points are connected to each other by hyperbolic or curved segments.

30 Claims, 16 Drawing Sheets
(16 of 16 Drawing Sheet(s) Filed in Color)

WEB OR SUPPORT STRUCTURE AND METHOD FOR MAKING THE SAME

FIELD AND BACKGROUND OF THE INVENTION

The present invention is directed to a web or support structure, and more particularly to a web or support structure that could be utilized to form structural elements.

Architects, civil and structural engineers conventionally utilize various web structures for supporting, for example, trusses, floors, columns, etc. Typically, web structures form various lattices or framework that support underlying or overlying supports. In this regard, structural engineers are quite familiar with a "Fink truss" (FIG. 2), the geometry of which encodes an approximation of a "Sierpinski triangle"—the "limit" of the recursive design indicated in FIGS. 1-3.

It has been observed in the past that the geometry of the hardest substance known to man, namely diamonds, and the modern roof truss encode and represent the approximations to certain fractals. The Fink truss (FIG. 2) is an engineering design that is a level-1 2-web. In nature, carbon-carbon bonding in diamond encodes a level-1 3-web.

In my earlier U.S. Pat. No. 6,931,812, which is hereby incorporated herein in its entirety by reference, I disclosed a 4-web structure represented in a 3-dimensional space that at a level-0 contains ten triangles.

The 2-web and 3-web date to circa 1900, while the 4-web from the $4^{th}$ dimension was realized within human vision late in the $19^{th}$ Century, and eventually published in the literature circa early 2003 (Reference No. 3). The 4-web is pictured on the cover of my book (Reference No. 2). Each of the 2-web, 3-web, 4-web, and 5-web are concrete examples of an abstract space that is referenced in the literature as "Lipscomb's Space" that I invented to solve a half-century old problem in dimension theory.

Page 20 of my book (Reference No. 2) contains mathematical details about the lower dimensional webs. In particular, the "ω with superscript 5" notation in the book denotes the 5-web, and the "J with subscript 6" notation also denotes the 5-web, where the 6=5+1 indicates the number of vertices of the 5-web. In general the "ω with superscript n" denotes an n-web and the "J with subscript n+1" also denotes the n-web, where n+1 indicates the number of vertices of the n-web.

Simply put, it has been an open problem to create a picture of an approximation to a 5-web within 3-space (human visual space). In the present disclosure, I use hyperbolic geometry to show how to visualize within 3-space (human visual space) such approximations to the 5-web. Topologically speaking, the new concept extends the 4-web design. Perhaps more importantly, however, is the fact that curved hyperbolic segments in the 5-web may induce more microscopic movement than the straight segments now used, for example, in the 4-web medical implants. Such result is likely to increase bone growth because the growth rate of bone is evidently increased by microscopic flexing of the 4-web segments.

Recalling again the value of "triangles" when it comes to designing high-strength structures, let us also recall that the 3-web level-0 (FIG. 4) has six struts and four triangles. The strength increases as the number of triangles increases. For example, I have shown in my unpublished article (Reference No. 1), that the addition of a single polar strut (compare FIG. 4 to the top half of FIG. 7), could increase compressive strength by as much as 20%. That is, the polar strut provides more triangles.

In order to understand the new 5-web design (subject of this application), recall that the "4" in "4-web" refers to the "$4^{th}$-dimension"—the place where the 4-web originally existed. There are also "2-webs", which exist in 2-dimensional planes, and "3-webs", which exist in 3-dimensional space (human visual space). Mathematically, this list of webs and corresponding dimensions continues ad infinitum. Sample illustrations of the webs existing in lower-dimensional space are shown in FIGS. 1-9.

More specifically, FIGS. 1-3 depict "levels" of 2-webs. Specifically, FIGS. 1-3 show a "level-0" (a single triangle), a "level-1" (three level-0 2-webs, illustrated as red, green, and blue), and a "level-2" 2-web (containing three level-1 2-webs), respectively. As the level-numbers increase, these structures approach a "limit", which is called the "2-web".

FIGS. 4-6 depict "levels" of 3-webs. Specifically, FIGS. 4-6 show a "level-0" (a single tetrahedron), a "level-1" (four level-0 3-webs, illustrated as red, green, blue, and gold), and a "level-2" 3-web (containing three level-1 3-webs), respectively. As the level-numbers increase, these structures approach a "limit", which is called the "3-web".

FIGS. 7-9 depict "levels" of 4-webs. Specifically, FIGS. 7-9 show a "level-0" (a single hexahedron), a "level-1" (five level-0 4-webs, illustrated as red, green, blue, gold, and black), and a "level-2" 4-web (containing five level-1 4-webs), respectively. Again, as the "level numbers" increase these structures approach a "limit" that is called a "4-web".

The key is to observe the inductive process, illustrated in FIGS. 1-9. The "inductive process" is a process that allows us to start at a given level, and then move to the next level using the given level. In more detail, the process is a two-step process. First, congruent copies of a given level are made. Second, these congruent copies are positioned so that each is just touching the others. To say that two congruent structures are "just touching" is to say that there exists one and only one point that is contained in both structures.

For example, consider the inductive process illustrated in FIGS. 4-6. We start with a tetrahedron (FIG. 4- four vertices), which is a level-0 3-web. Then, we create four congruent copies (colored red, green, blue, and gold). Next, we position these four copies so that each is just touching the other three. This positioning is shown in FIG. 5. To find the just-touching points, simply seek the points where two distinct colors meet. In particular, find the point where the red congruent copy meets the green congruent copy. That point is the "just touching point" for those copies. The construction of congruent copies followed by the "just touching" positioning allows one to move from one level to the next to infinity. Such an algorithm defines the inductive process.

In summary, the Fink truss (FIG. 2), which is a level-1 Sierpinski triangle, has been utilized for many years in constructing various support structures. To date, diamond which has the geometry of a level-1 Sierpinski cheese as its basic building structure is known to be the hardest structure. In the present invention, I have discovered a geometrical structure that represents the next step over the 4-web structure, i.e., the 5-web structure.

ASPECTS AND SUMMARY OF THE INVENTION

The present disclosure is directed to various aspects of the present invention.

One aspect of the present invention is to provide the medical, scientific, engineering, technical, and architectural communities with access to new fundamental designs, i.e., designs that systematically produce homogeneous structures that contain large numbers of triangles constructed with a minimum amount of material. That is, light-weight but exceptionally strong structures.

Another aspect of the present invention is to provide a web structure which could be utilized at both macroscopic and microscopic levels to create stronger and more stable structures. On a microscopic scale, for example, a web structure made in accordance with the present invention would produce new compounds and new crystals. Another example is to create structures, such as medical implant devices that enhance bone growth. On a macroscopic scale, for example, a web structure made in accordance with the present invention would create super strong and stable architectural and structural support structures. For example, a web structure of the present invention can be utilized to create super strong and stable trusses, beams, floors, columns, panels, airplane wings, etc.

Another aspect of the present invention is to provide the scientific and solid-state physics communities with access to new fundamental web-structure designs that would indicate how to build new compounds and new crystals having utility, for example, in the solid-state electronics industry.

Another aspect of the present invention is to provide a web structure that accommodates or packs more triangular shapes into a given volume than conventional web structures. A web structure made in accordance with the present invention could be used in building bridges, large buildings, space-stations, etc. In the space-station case, for example, a basic, modular and relatively small web structure can be made on earth, in accordance with the present invention, and a large space-station could be easily built in space by shipping the relatively small (level-0) web into space, and then joining it with other members according to the "just-touching" feature of web designs.

Another aspect of the present invention is to provide a web structure that represents a 5-web in a 3-dimensional space.

Another aspect of the present invention is to provide a 5-web structure that packs or accommodates more triangles in a given volume than the previous 4-web structure.

Another aspect of the present invention is to provide a web structure that at level-0 packs or accommodates 15 Fink struts and 20 hyperbolic triangles.

Another aspect of the present invention is to provide a web structure including six points (or apices or vertices), wherein no two points are equal, no three points lie on a straight line, no four points lie on a plane, each pair of points is connected, by a hyperbolic or curved segment, which, in pairs, meet, if at all, only in a single common vertex, and, in addition, the structure serves as a level-0 5-web, copies of which may be used to build a level-1 5-web, etc.

Another aspect of the present invention is to provide a web structure including a generally octahedron-shaped frame having a first set of a plurality of points oriented in a first plane, and a second set of a plurality of points oriented in a second plane generally parallel to the first plane. The first and second sets of points are connected to each other by hyperbolic or curved segments.

Another aspect of the present invention is to provide a web structure having a generally octahedron-shaped frame including six vertices and eight triangular faces (or surfaces). Each face includes at least one hyperbolic edge.

Another aspect of the present invention is to provide a method of forming a web structure, which includes providing a plurality of generally octahedron-shaped frames, each frame, including i) six vertices, ii) a first set of a plurality of points oriented in a first plane, iii) a second set of a plurality of points oriented in a second plane generally parallel to the first plane, and iv) every pair of points in the union of the first and second sets of points are connected to each other by hyperbolic segments. In addition, these frames may be positioned so that each "just touches" the others.

Another aspect of the present invention is to provide a web structure including a generally octahedron-shaped frame having a first set of three points oriented in a first plane, and a second set of three points oriented in a second plane generally parallel to the first plane. The six points in the first and second sets of points are connected to the other five by hyperbolic segments.

In summary, the main aspect of the present invention is to provide a 5-web structure in a 3-dimensional space. The invention can be utilized to generate new structural designs that relate to both macroscopic and microscopic structures. These structures would be stronger and more stable than the presently known structures, including diamond and those utilizing the 4-web structure shown in my earlier patent, U.S. Pat. No. 6,931,812.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

One of the above and other aspects, novel features and advantages of the present invention will become apparent from the following detailed description of the non-limiting preferred embodiment(s) of invention, illustrated in the accompanying drawings, wherein:

FIGS. 15, 17, 19 and 21 are top plan views of FIGS. 14, 16, 18 and 20, respectively;

DETAILED DESCRIPTION OF THE PREFERRED EMBODIMENT(S) OF THE

As described above, a 3-web may be viewed as a systematic packing of tetrahedra in 3-dimensional space, and a 4-web may be viewed as a systematic packing of hexahedra in 3-dimensional space. Here, the present invention illustrates a systematic packing of (hyperbolic) octrahedra that creates a new form or configuration in 3-dimensional space.

Figure 1:
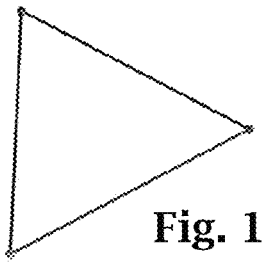
FIG. 1 illustrates a Sierpinski's triangle or a level-0 2-web.
Figure 2:
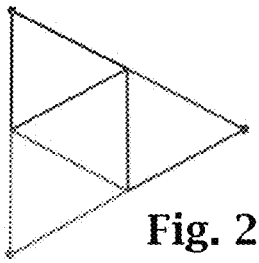
FIG. 2 illustrates a Fink truss or a level-1 2-web.
Figure 3:
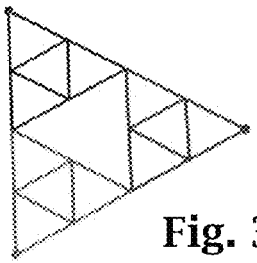
FIG. 3 illustrates a level-2 2-web.
Figure 4:
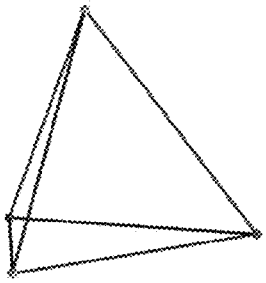
FIG. 4 illustrates a level-0 3-web.
Figure 5:
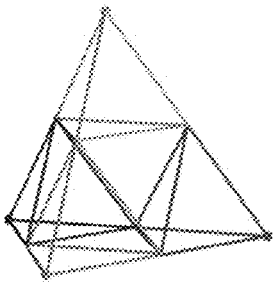
FIG. 5 illustrates a level-1 3-web.
Figure 6:
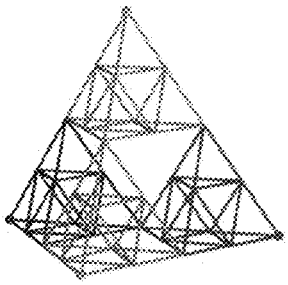
FIG. 6 illustrates a level-2 3-web.
Figure 7:
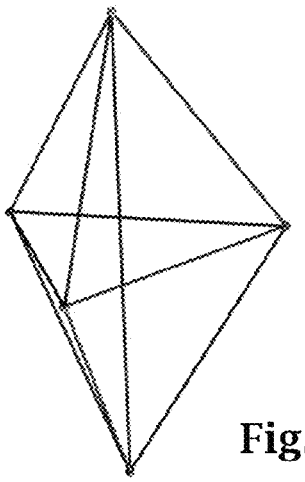
FIG. 7 illustrates a level-0 4-web.
Figure 8:
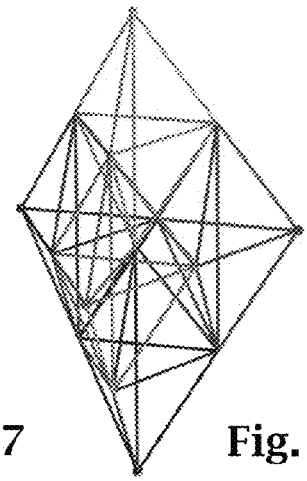
FIG. 8 illustrates a level-1 4-web.
Figure 9:
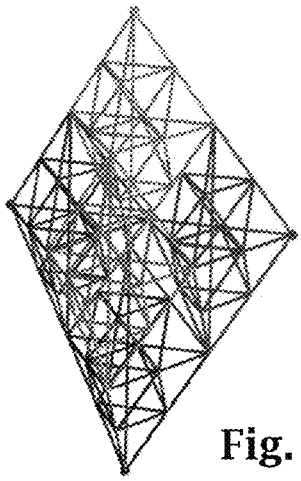
Fig. 9 (Prior Art)
FIG. 9 illustrates a level-2 4-web.
Figure 10:
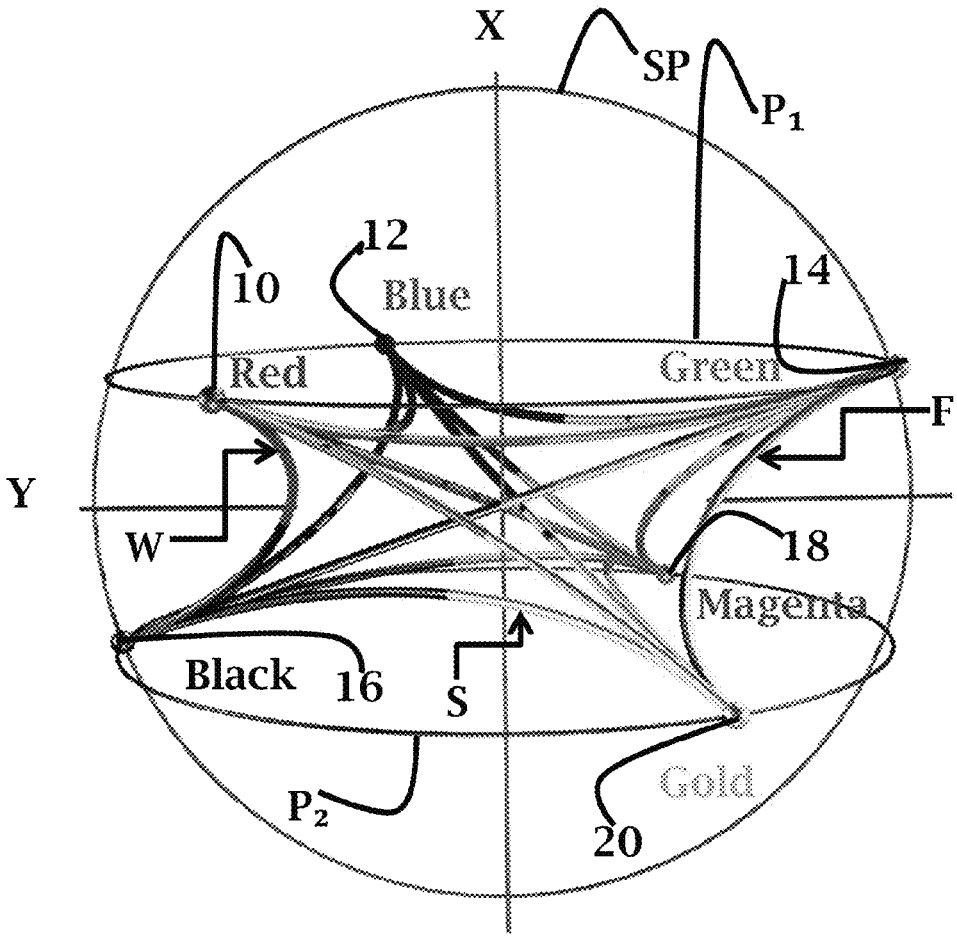
FIG. 10 illustrates a level-0 5-web structure formed in accordance with a preferred embodiment of the present invention, shown relative to a sphere.
Figure 11:
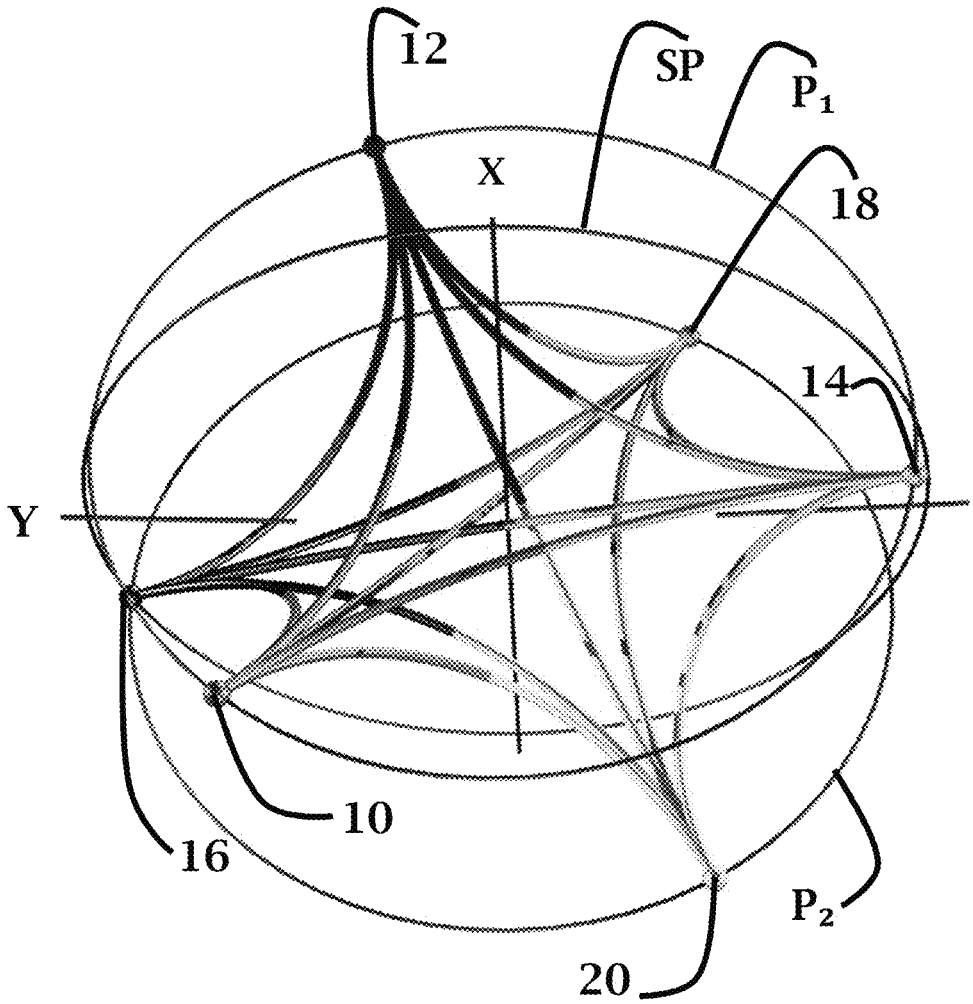
FIG. 11 is a view of the web structure shown in FIG. 10, shown rotated 45° relative to the Y-axis.

The web structure in accordance with a preferred embodiment of the present invention in its simplest form (level-0) is best illustrated in FIG. 10, shown relative to a unit sphere SP, represented in a 2-dimensional circle for clarity. As shown, the web structure W includes a generally octahedron-shaped frame F oriented in the sphere SP. The frame F includes three upper points or apices (or vertices) 10, 12, and 14 (also shown as red, blue, and green, respectively) oriented in a preferably circular upper plane $P_1$. Likewise, three lower points or apices (or vertices) 16, 18, and 20 (also shown as black, magenta, and gold, respectively) are oriented in a preferably circular lower plane $P_2$. The planes $P_1$ and $P_2$ are generally parallel to each other and the points 10, 12, 14, 16, 18, and 20, are all connected to each other by hyperbolic or curved lines or segments, described below in more detail. Also see FIGS. 11-12.

Figure 13:
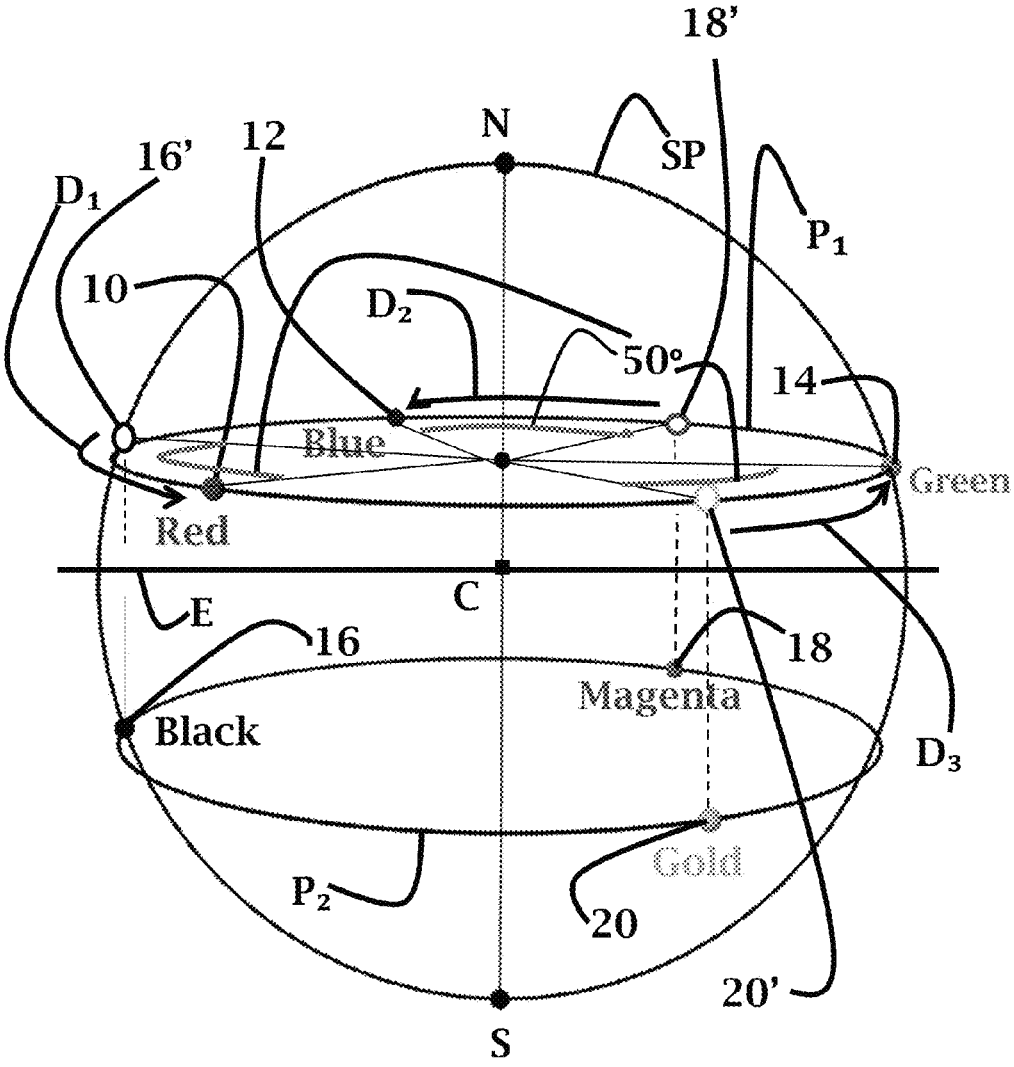
FIGS. 13-21 illustrate a preferred sequence for the formation of a level-0 5-web structure, in accordance with a preferred embodiment of the present invention. More specifically.

Referring now to FIGS. 13-22, the formation of a level-0 5-web will now be described. As shown in FIG. 13, upper points or apices 10, 12, and 14 are separated from each other by an angular distance of about 120° in the upper plane $P_1$. Likewise, the lower points 16, 18, and 20, are also separated from each other by an angular distance of about 120° in the lower plane $P_2$. In this regard, it is noted that once one of the upper or lower set of points is located, the other set of points is found by reflecting through the equatorial plane E and rotating or offsetting by about 50°.

For example, upon location of the point 16 (black) in the lower plane $P_2$, the corresponding upper point 10 (red) in the upper plane $P_1$ is obtained by first creating the mirror image of point 16 (shown as 16') relative to the equatorial plane E, and second by rotating this mirror image of point 16 by about 50° counterclockwise in the $P_1$ plane (see arrow $D_1$) about the north pointing axis starting at C and ending at N, as shown in FIG. 13.

Likewise, the angular distance between the points 12 (blue) and the mirror image of point 18 (magenta), is also 50°. As shown in FIG. 13, the point 12 (blue) is obtained by rotating the mirror image 18' of the point 18 (magenta) counterclockwise in the $P_1$ plane (see arrow $D_2$) about the north pointing axis starting at C and ending at N. In the same manner, the angular distance between the upper point 14 (green) and the mirror image of the point 20 (gold) is obtained to be about 50°. As shown in FIG. 13, the point 14 (green) is obtained by rotating the mirror image 20' of the point 20 (gold) counterclockwise in the $P_1$ plane (see arrow $D_3$) about the north pointing axis starting at C and ending at N.

It is noted herewith that in FIG. 13, N and S denote North and South poles, and C represents the center of polar axis, and these are shown for the ease of understanding the web structure W of the present invention. In other words, the upper and lower planes $P_1$ and $P_2$, do not necessarily have to be oriented horizontally, and can extend, for example, in vertical or slanted planes.

Figure 14:
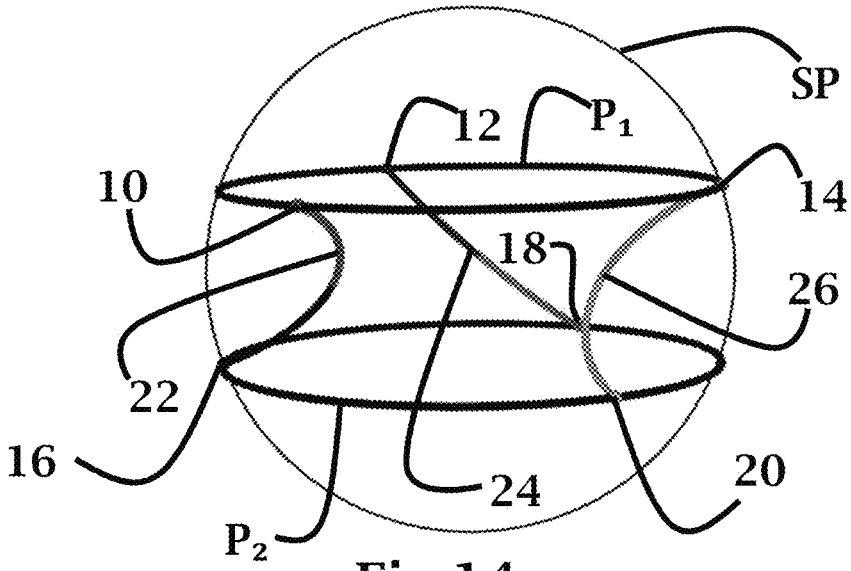

Next, in FIG. 14 the upper points 10, 12, and 14 are connected to the corresponding lower points 16, 18, and 20, respectively, by short hyperbolic or curved segments 22, 24, and 26. In particular, points 10 and 16 are connected by segment 22, points 12 and 18 are connected by segment 24, and the points 14 and 20 are connected by segment 26. Also see FIG. 15 that shows the top plan view of FIG. 13.

Figure 16:
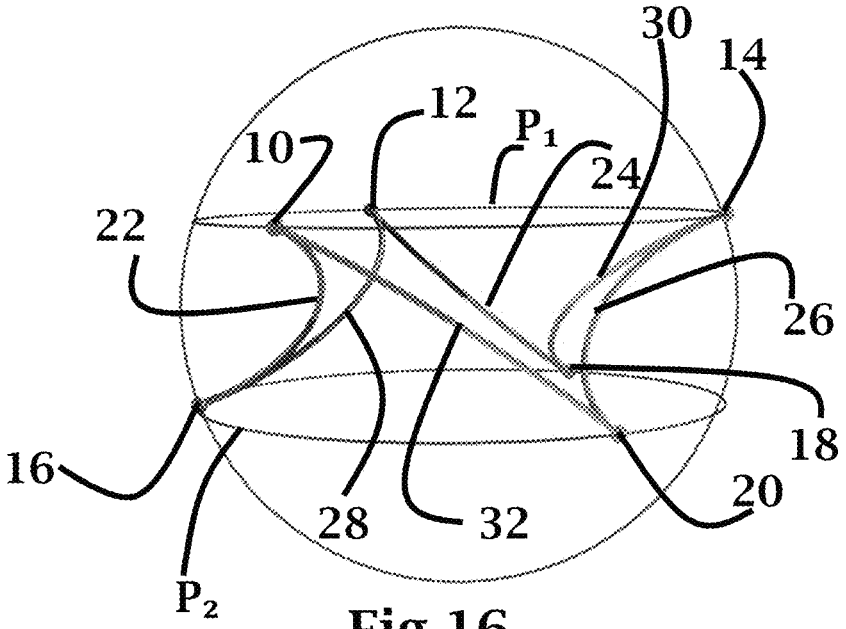
Figure 17:
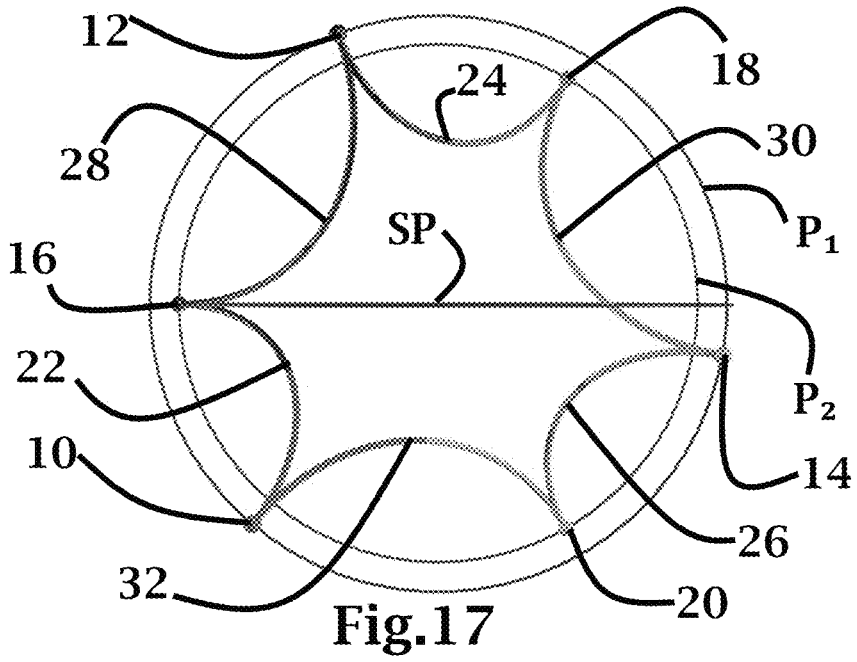

Referring to FIGS. 16 and 17 (showing elevational and top views, respectively) in the next step, points 12 and 16 (blue and black), 14 and 18 (green and magenta), and 10 and 20 (red and gold) are connected by medium length segments 28, 30, and 32, respectively.

Figure 18:
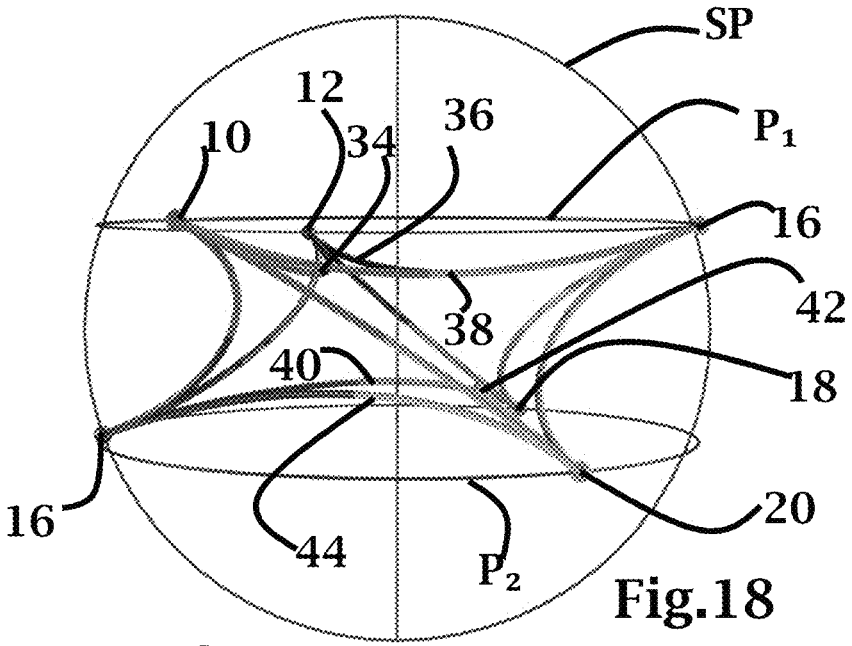
Figure 19:
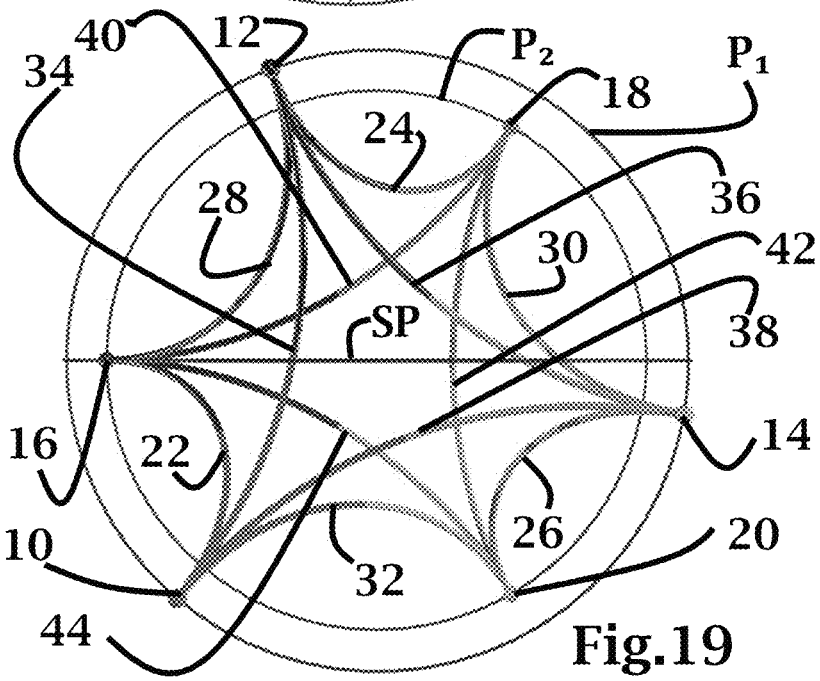

Referring to FIGS. 18-19, the points 10 and 12 (red and blue), 12 and 14 (blue and green), 10 and 14 (red and green), 16 and 18 (black and magenta), 18 and 20 (magenta and gold), and 16 and 20 (black and gold), are then connected by six long length segments 34, 36, 38, 40, 42 and 44, respectively. See the elevational view of FIG. 18, showing only the long segments for clarity and ease of understanding, and the top plan view of FIG. 19, showing the short, medium and long segments.

Figure 20:
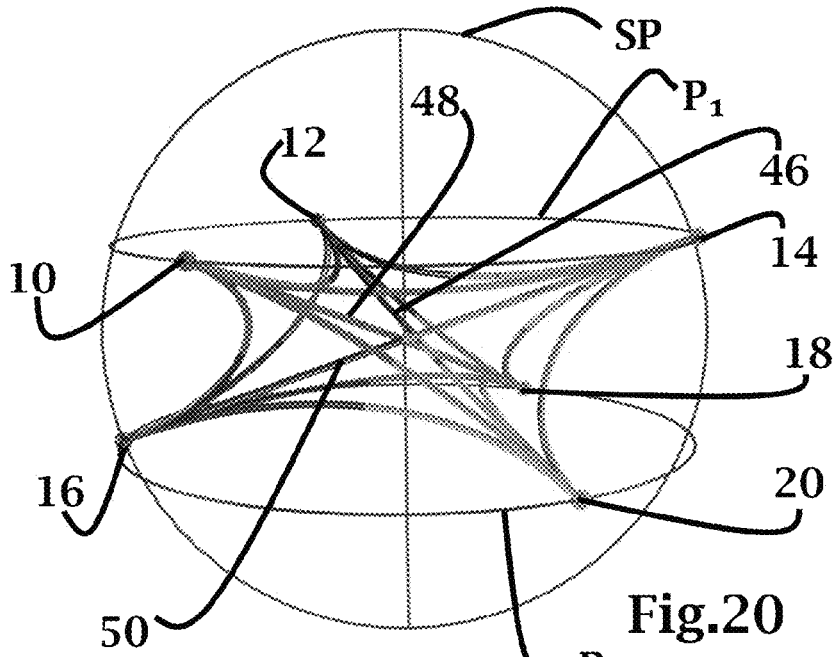
Figure 21:
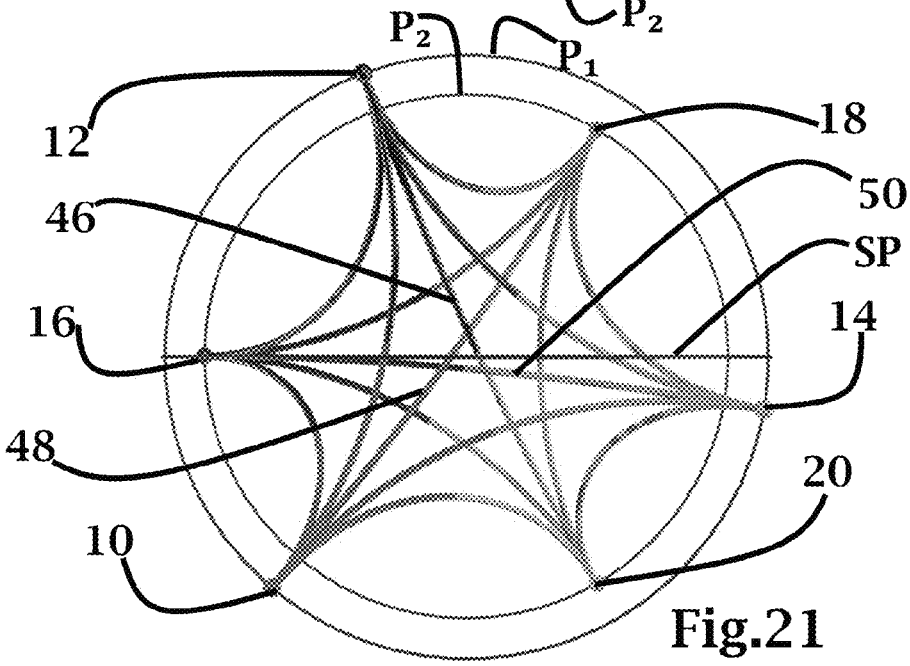

Referring to FIGS. 20 and 21 (showing elevational and top plan views, respectively), the final step in constructing the level-0 5-web structure will now be described. (It is noted herewith that only the final and three longest segments 46, 48, and 50 are labeled for clarity and better understanding.)

As shown in FIGS. 20 and 21, points 12 and 20 (blue and gold), 10 and 18 (red and magenta), and 14 and 16 (green and black) are connected by three longest segments 46, 48, and 50, respectively.

The following is a Table showing the preferable lengths of the 15 segments used to construct a level-0 5-web.

TABLE 1

Lengths of Hyperbolic Segments in a Level-0 5-web

Figure 15:
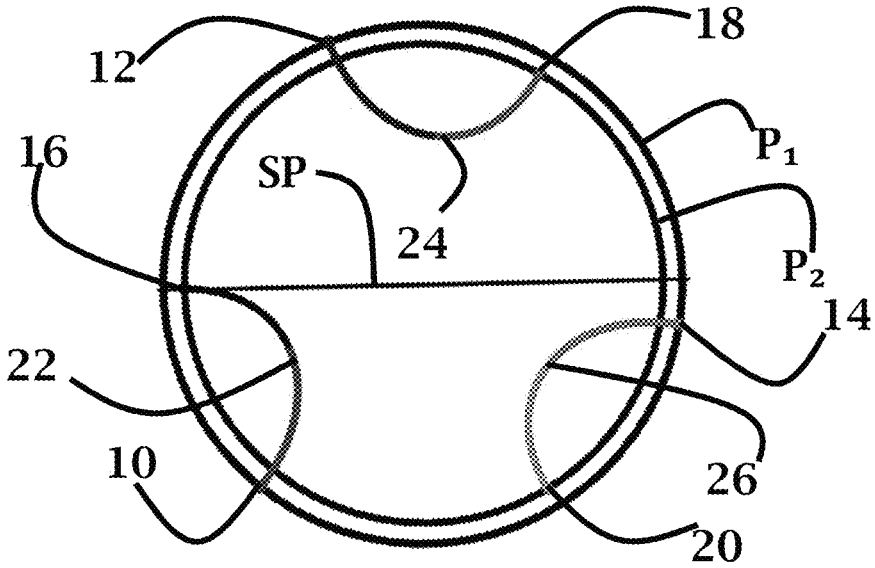

| | No. | LENGTH | UNITS* (APPROX.) | SEGMENTS | COLOR CODE |
|---|---|---|---|---|---|
| FIG. 15 | 3 | Short | 1.25 | 22, 24, and 26 | Red-Black, Blue-Magenta, Green-Gold |
| FIG. 17 | 3 | Medium | 1.45 | 28, 30 and 32 | Black-Blue, Magenta-Green, Red-Gold |
| FIG. 19 | 6 | Long | 1.74 | 34, 36, 38 40, 42 and 44 | Red-Blue, Blue-Green, Red-Green Black-Magenta, Magenta-Gold, Black-Gold |
| FIG. 21 | 3 | Longest | 1.99 | 46, 48 and 50 | Blue-Gold, Red-Magenta, Black-Green |

*It is noted that the units correspond to any unit of measurement. For example, if the unit sphere (SP) is a sphere with a radius of 1 inch, then the units noted herein would all be in inches.

Figure 22:
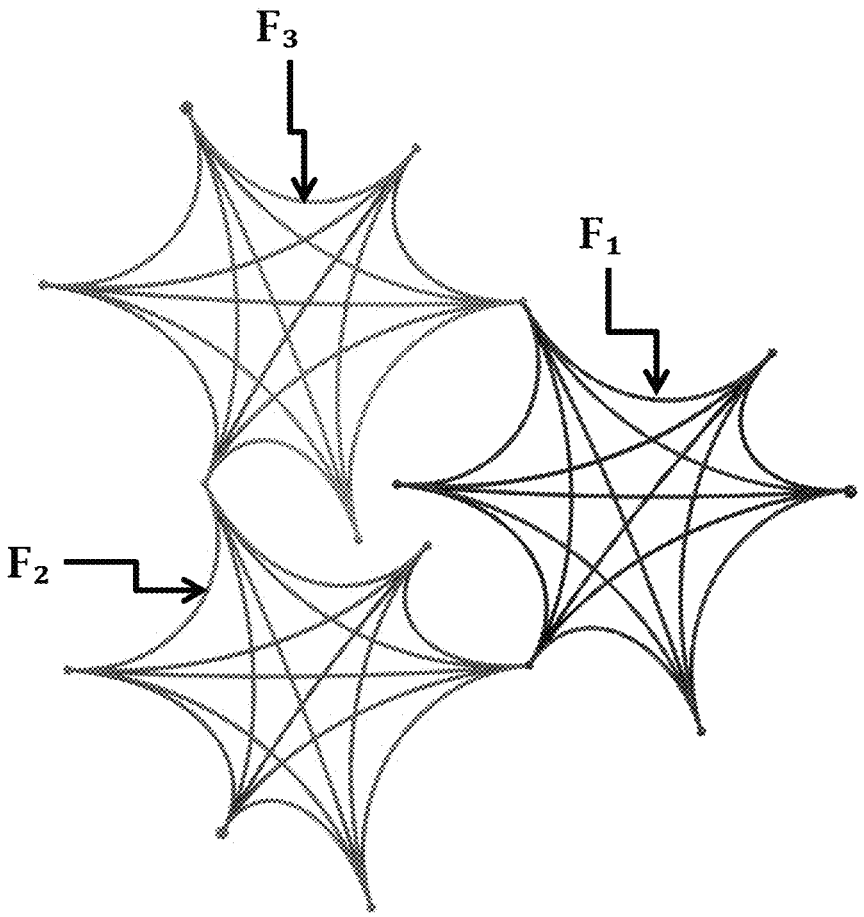
FIGS. 22-24 illustrate a preferred sequence for the formation of a level-1 5-web structure from the web structure shown in FIG. 10.
Figure 23:
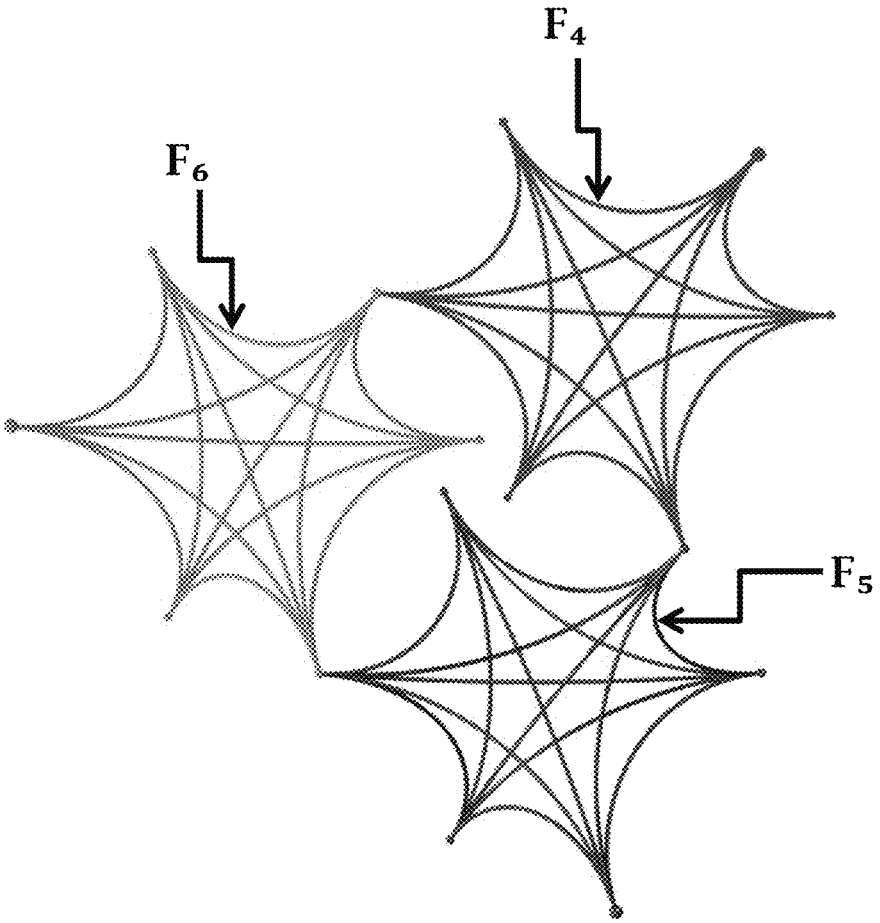
Figure 24:
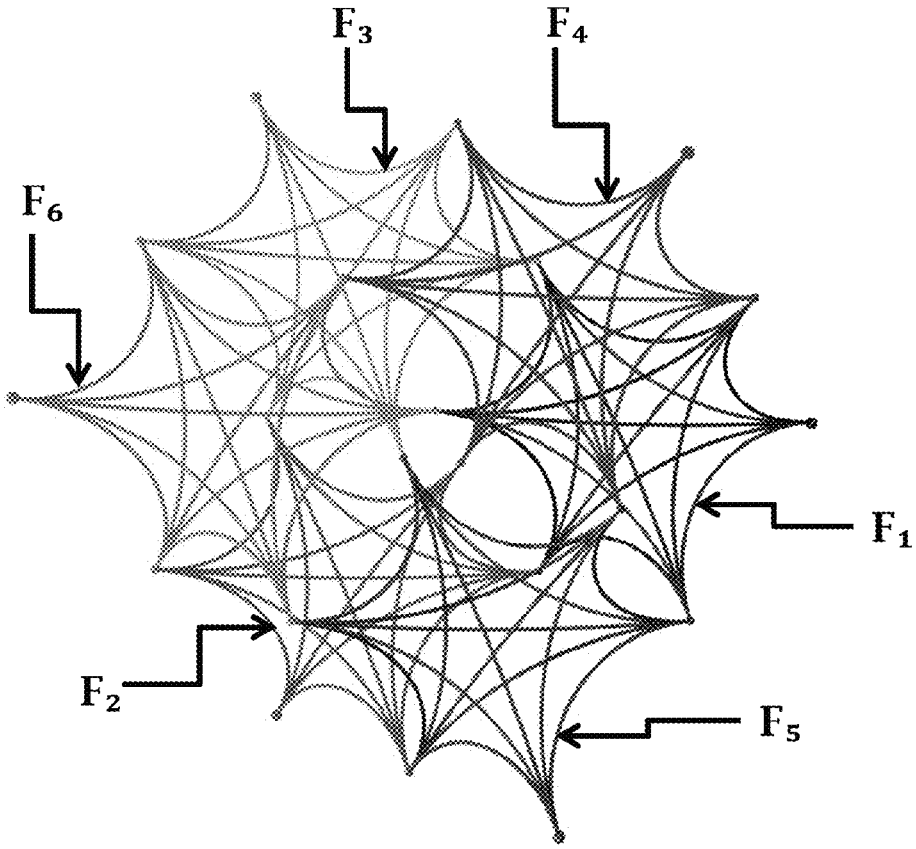

FIGS. 22-24 illustrate the formation of a level-1 5-web. In particular, FIG. 22 illustrates three congruent copies or duplications of the frame F of FIG. 10, shown as $F_1$, $F_2$, and $F_3$, illustrated in black, magenta, and gold, respectively. Likewise, FIG. 23 illustrates another set of three congruent copies of the frame F as $F_4$, $F_5$, and $F_6$, shown in red, blue, and green, respectively. As shown in FIG. 24, the six level-0 5-web frames $F_1$, $F_2$, $F_3$, $F_4$, $F_5$, and $F_6$ are oriented together in a manner that five points or apices of each individually touches or engages the other five frames. As for an algorithm that positions these six level-0 5-webs, first start with a single level-0 5-web and color it black so it appears as $F_1$ in FIG. 24. Then second, color each of its other five vertices using blue, red, green, gold, and magenta colors. Then third, keeping $F_1$ fixed, use the black vertex and, e.g., say the blue vertex on $F_1$ to draw a straight-line segment from the black to the blue vertex. Then fourth, slide (no rotations allowed) the entire $F_1$ along this line segment until its black vertex occupies its blue vertex position. This "blue-vertex" position of $F_1$ defines the position of $F_5$ (the blue level-0 5-web in FIG. 24). Likewise, the other colored vertices of $F_1$, with $F_1$ back at its starting point, are used to define the positions of $F_2$, $F_3$, $F_4$, and $F_6$.

Figure 25:
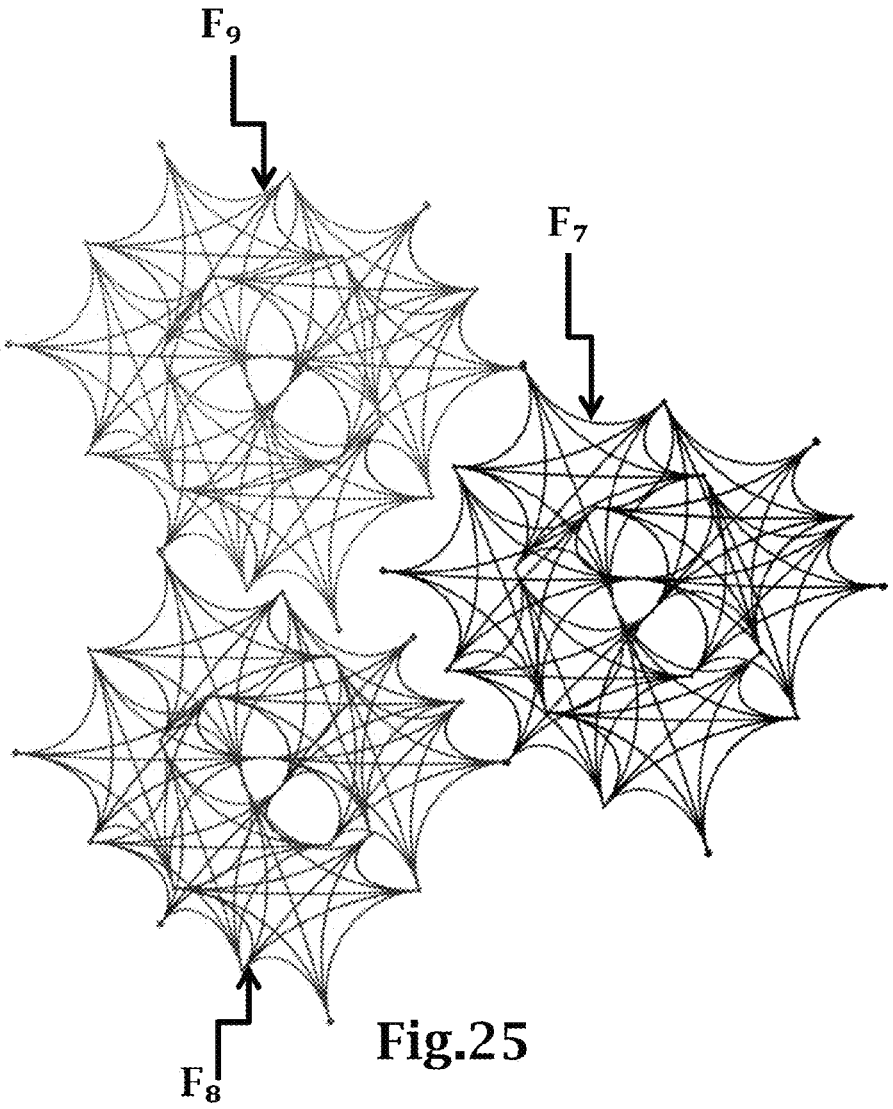
FIGS. 25-27 illustrate a preferred sequence for the formation of a level-2 5-web structure from the web structure shown in FIG. 24.
Figure 26:
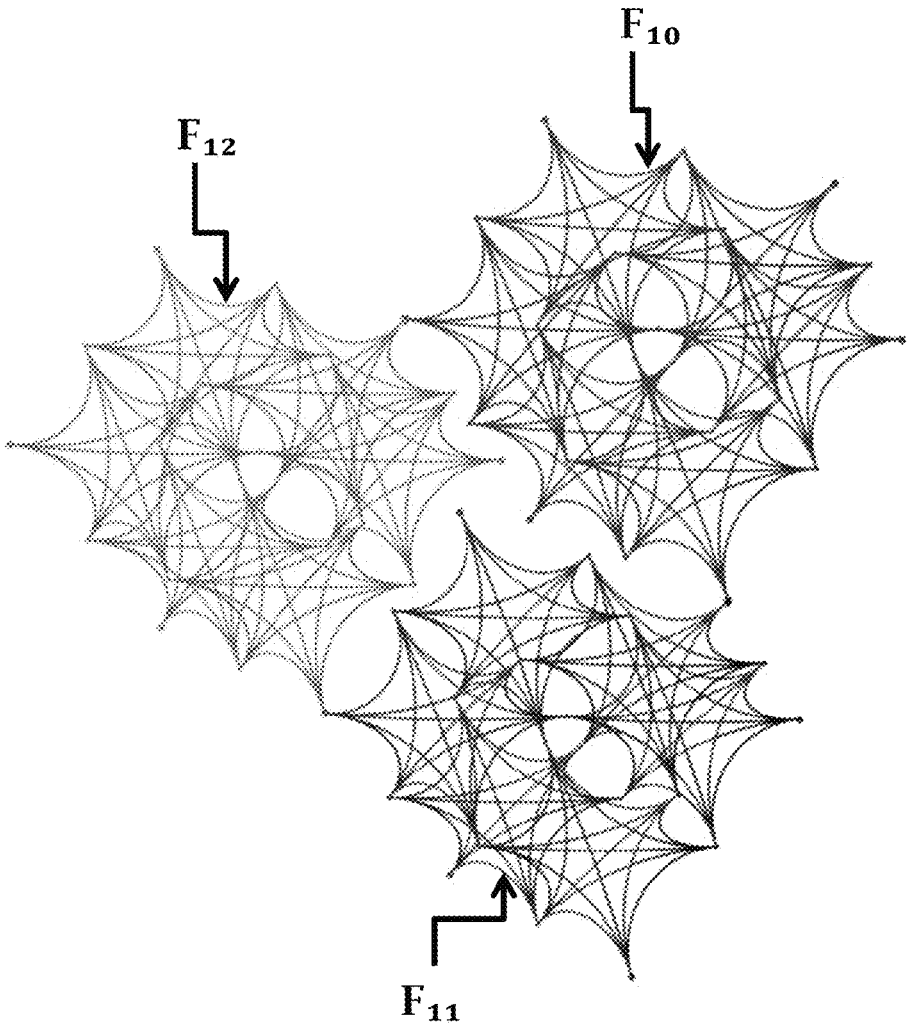
Figure 27:
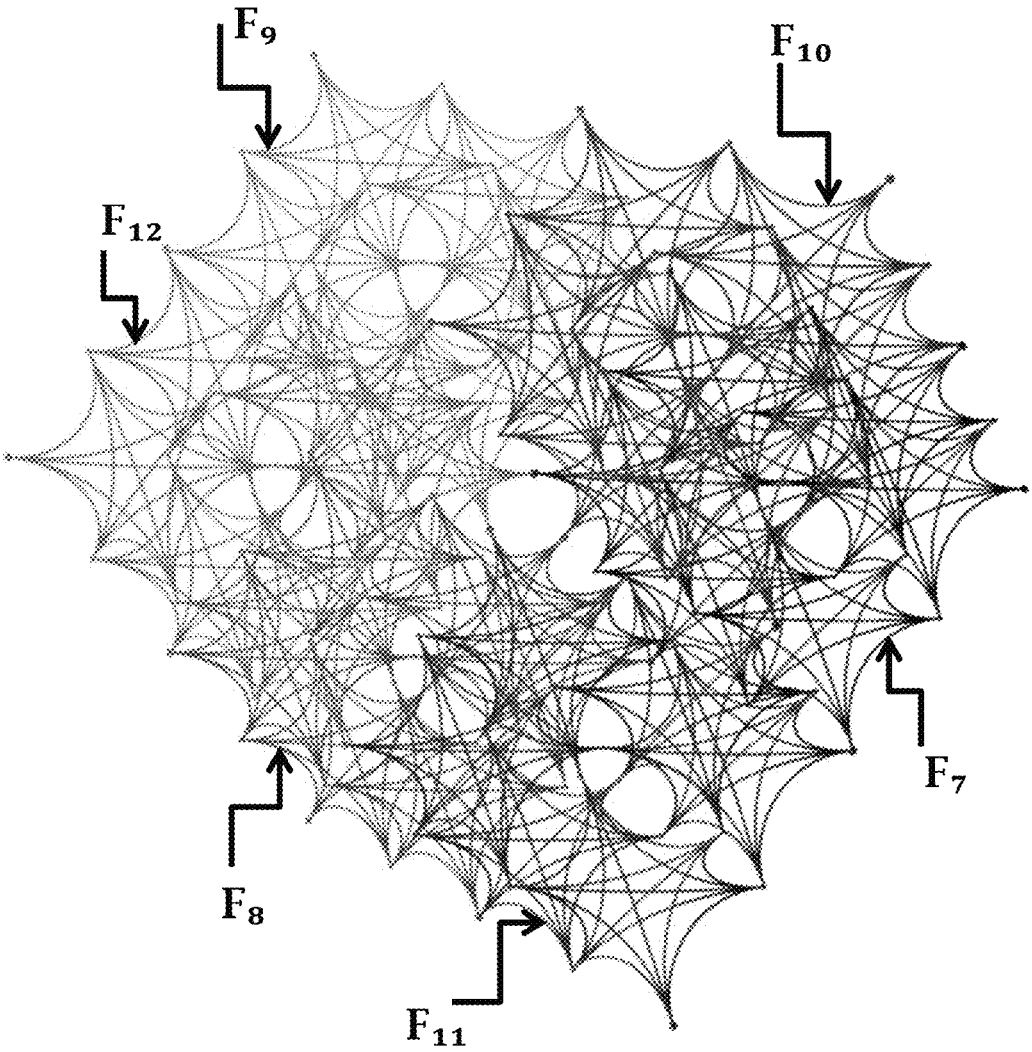
Figure 30:
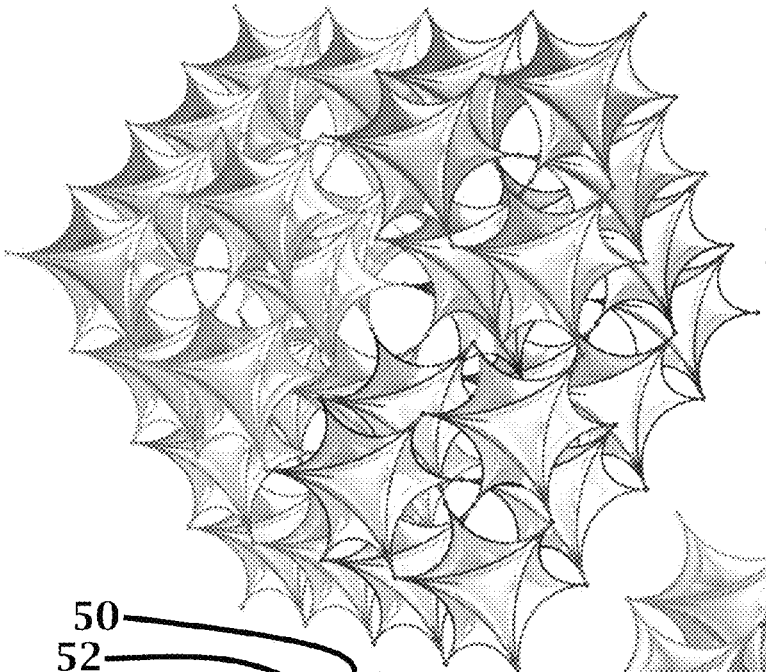
FIGS. 28-30 illustrate a level-0 5-web, a level-1 5-web, and a level-2 5-web, respectively, with triangular surfaces defined by the hyperbolic or curved edges.

FIGS. 25-27 illustrate the formation of a level-2 5-web. In particular, FIG. 25 illustrates three level-1 5-webs $F_7$, $F_8$, and $F_9$ (shown in black, magenta, and gold, respectively) each constructed as shown in FIG. 24. Likewise, FIG. 26 illustrates three level-1 5-webs $F_{10}$, $F_{11}$, and $F_{12}$ (shown in red, blue, and green, respectively) also constructed as shown in FIG. 24.

As shown in FIG. 27, the six level-1 5-web frames $F_7$, $F_8$, $F_9$, $F_{10}$, $F_{11}$, and $F_{12}$, are positioned in a manner that each "just touches" the other five. The algorithm that provides the "just touching" positions of these six level-1 5-web frames is the algorithm detailed in paragraph [0060] above that provided the "just touching" positions for six level-0 5-web frames.

Figure 28:
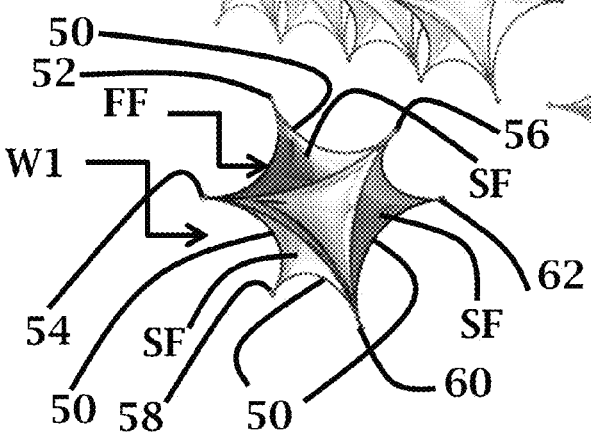

FIG. 28 illustrates another preferred embodiment of the web structure of the present invention, wherein in particular the web structure W1 is similar to the level-0 5-web shown in FIG. 10, with the exception of the frame FF including up to eight triangular faces or surfaces SF defined by hyperbolic or curved edges 50.

As in the previous embodiments, the frame FF includes six points or apices (or vertices) 52, 54, 56, 58, 60, and 62. The web structure W1 can be solid or hollow in configuration.

Figure 29:
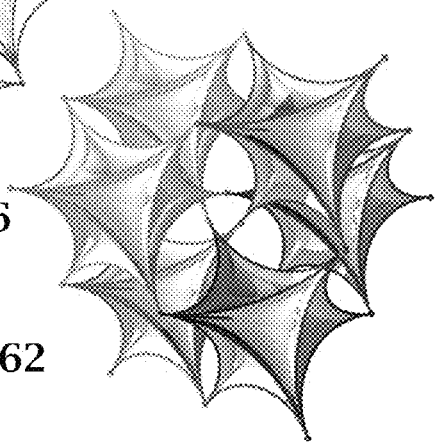

As illustrated in FIG. 29, six congruent copies or duplications of the level-0 5-web structure shown in FIG. 28, can be arranged or oriented to create a level-1 5-web, in the same fashion as shown above in FIG. 24.

Likewise, six congruent copies or duplications of the web structure shown in FIG. 29 (level-1 5-web) can be arranged or oriented in the same manner as described above with respect to FIG. 27, to create a level-2 5-web.

Figure 12:
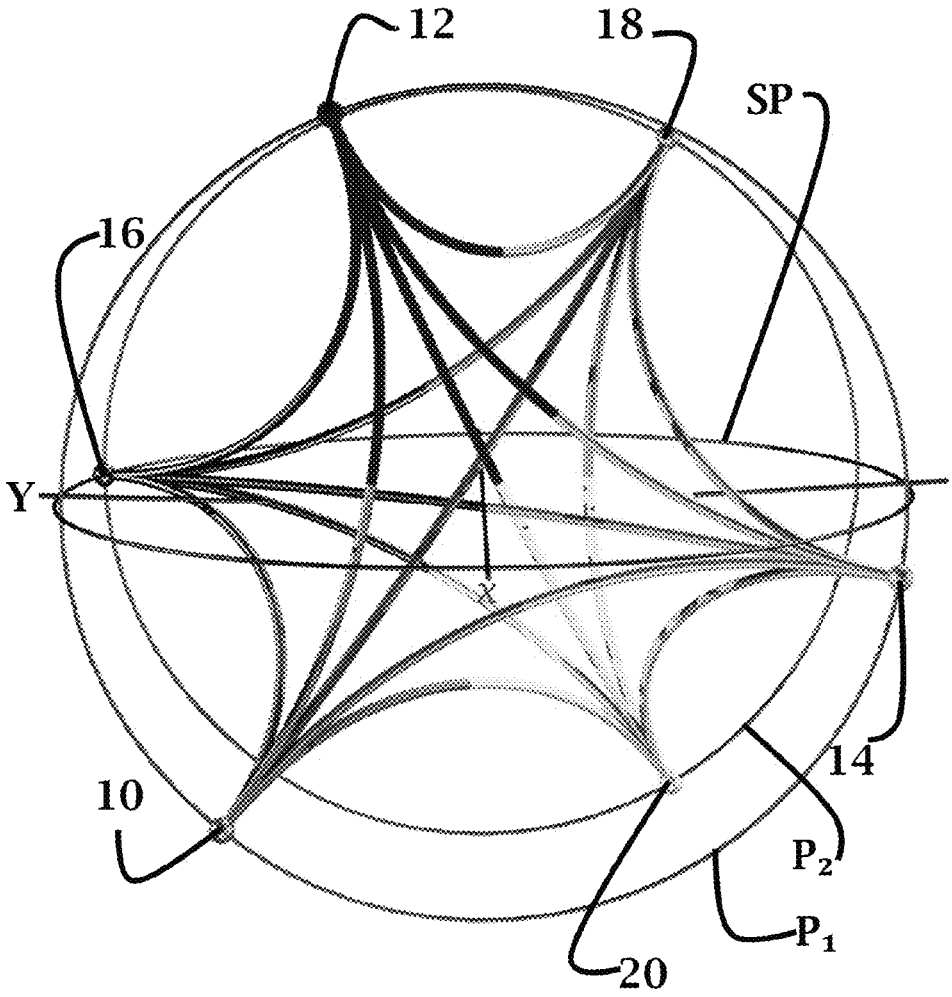
FIG. 12 is a view of the web structure shown in FIG. 10, shown rotated 90° relative to the Y-axis.

From a review of the above description, and specifically FIGS. 12 and 21, one skilled in the art would appreciate that a level-0 5-web structure constructed in accordance with an embodiment of the invention, would include twenty triangles and fifteen segments or struts.

Level-0 5-Web Vertices and Hyperbolic Edges

The following example provides coordinates for six vertices of a 5-web, providing mathematics that shows how one layer of three vertices transforms into the other layer of three vertices. And an algorithm for constructing the hyperbolic arcs that serve as curved segments in a level-0 5-web is also provided.

Vertices

From FIG. 10, the six vertices of the level-0 5-web are points on the unit sphere, i.e., points that satisfy the following equation $x^2+y^2+z^2=1$. Coordinates of the U=black colored, V=gold colored, and W=magenta colored vertices on $P_2$ are:

$$U=(-\tfrac{1}{3}, (2\sqrt{2})/3, 0),$$
$$V=(-\tfrac{1}{3}, -\sqrt{2}/3, \sqrt{2}/\sqrt{3}),$$
$$W=(-\tfrac{1}{3}, -\sqrt{2}/3, -\sqrt{2}/\sqrt{3})$$

Each of the three vertices within $P_2$ has "$-\tfrac{1}{3}$" as its "x" coordinate and is in the "$x=-\tfrac{1}{3}$ plane". So reflection through the "x=0 plane" (equator) produces corresponding vertices in the "$x=+\tfrac{1}{3}$ plane". Then rotating by ø=50 degrees about the polar axis we obtain, via a standard rotation matrix, the three vertices within $P_1$, namely, U'=red, V'=green, and W'=blue.

$$P_1(x\text{ coordinate})=\tfrac{2}{3}+P_2(x\text{ coordinate})$$

$$P_1(y\text{ coordinate})=P_2(y\text{ coordinate})\cos ø-P_2(z\text{ coordinate})\sin ø$$

$$P_1(z\text{ coordinate})=P_2(y\text{ coordinate})\sin ø+P_2(z\text{ coordinate})\cos ø$$

The mirror image map $(-\tfrac{1}{3},y,z)\rightarrow(+\tfrac{1}{3},y,z)$ followed by the ø=50 degree rotation matrix yields $$U'=(\tfrac{1}{3}, [(2\sqrt{2})\cos ø]/3, [(2\sqrt{2})\sin ø]/3),$$

$$V'=(\tfrac{1}{3}, -(\sqrt{2}/3)\cos ø-(\sqrt{2}/\sqrt{3})\sin ø, -(\sqrt{2}/3)\sin ø+(\sqrt{2}/\sqrt{3})\cos ø),$$

$$W'=(\sqrt{1}/3, -(\sqrt{2}/3)\cos ø+(\sqrt{2}/\sqrt{3})\sin ø, -(\sqrt{2}/3)\sin ø-(\sqrt{2}/\sqrt{3})\cos ø).$$

For approximations of the transformation above, we use the arrow "→" to illustrate the transformation "(vertices in $P_2$)→(vertices in $P_1$)" "U, V, W pre-images→U', V', W' images":

$$U=(-0.333, 0.9428, 0)\rightarrow U'=(0.333, 0.606, 0.722)$$

$$V=(-0.333, -0.4714, 0.8165)\rightarrow V'=(0.333, -0.928, 0.164)$$

$$W=(-0.333, -0.4714, -0.8165)\rightarrow W'=(0.333, 0.322, -0.886)$$

Edges

To calculate the 15 hyperbolic edges or segments (Table 1) that serve to connect every pair of these six vertices, let a and b denote a pair of vectors whose endpoints a and b respectively represent two such points. Draw a straight line segment (cord) [a,b] with end points a and b. Let m be the midpoint of [a,b] and the endpoint of the vector m. Then calculate the length ||m|| of m. Next, scale (with a positive number) the vector m to obtain a vector m' whose length ||m'|| satisfies $\|m\|\times\|m'\|=1$. Then the endpoint m' of m' is the inversion point of the point m. Finally, construct a circle in the plane containing the points a and b whose center is located at the endpoint m' of m' and whose radius is $\|m'-a\|=\|m'-b\|$. The arc of this circle that lies inside the unit sphere is the hyperbolic line segment connecting the points a and b.

A web structure constructed in accordance with the present invention can be made of any suitable material such as wood, plastic, metal, metal alloy such as steel, fiberglass, glass, polymer, concrete, etc., depending upon the intended use or application, or choice. Further, it can be used alone or part of another structure, or used as a spacer. For example, one or more web structures can be arranged between two or more panels as spacers to add strength to the overall structure.

It is noted herewith that while the invention has been described for constructing level-0, level-1 and level-2 5-webs, it may be applied to create webs of higher levels. It is further noted herewith that the invention is not limited in any way to any color choice or scheme, which is used here merely for the purpose of illustration and ease of understanding.

While this invention has been described as having preferred/illustrative mathematical levels, sequences, ranges, steps, order of steps, materials, structures, symbols, indicia, graphics, color scheme(s), shapes, configurations, features, components, or designs, it is understood that it is capable of further modifications, uses and/or adaptations of the invention following in general the principle of the invention, and including such departures from the present disclosure as those that come within the known or customary practice in the art to which the invention pertains, and as may be applied to the central features hereinbefore set forth, and fall within the scope of the invention and of the limits of the claims appended hereto or presented later. The invention, therefore, is not limited to the preferred embodiment(s) shown/described herein.

REFERENCES

The following references, and any cited in the disclosure herein, are hereby incorporated herein in their entirety by reference.

1. S. L. Lipscomb, *Compression and Core Geometry of two panels*, Unpublished, 2005.
2. S. L. Lipscomb, *Fractals and Universal Spaces in Dimension Theory*, Springer Monographs in Mathematics, 2009.
3. J. Perry and S. Lipscomb, *The generalization of Sierpinski's triangle that lives in* 4-*space*, Huston Journal of Mathematics, vol. 49, No. 3, 2003, pp. 691-710.
4. Greenberg, Marvin J. "Euclidean and Non-Euclidean Geometries" Development and History (second edition). Published by W.H. Freeman and Company. Copyright 1972 by Marvin Jay Greenberg and Copyright 1974, 1980 by W.H. Freeman and Company.

What is claimed is:

1. A web structure, comprising:
a) a generally octahedron-shaped frame;
b) said frame comprising a first set of a plurality of points oriented in a first plane;
c) said frame comprising a second set of a plurality of points oriented in a second plane generally parallel to said first plane; and
d) each of said points in said first set being connected to each of said points in said second set by hyperbolic segments.

2. The web structure of claim 1, wherein:
a) each of said first and second sets comprises three points forming a hyperbolic triangle.

3. The web structure of claim 2, wherein:
a) each of said first and second planes comprises a generally circular plane having a coincident central axis.

4. The web structure of claim 3, wherein:
a) the three points in said first set are offset by about 50° relative to the corresponding three points in said second set about the central axis.

5. The web structure of claim 1, wherein:
a) said frame comprises twenty triangles and fifteen segments.

6. The web structure of claim 5, wherein:
a) the fifteen segments are of varied lengths.

7. The web structure of claim 5, wherein:
a) the fifteen segments comprise groups of three short, three medium, six long, and three longest in about 1.25, about 1.45, about 1.74, and about 1.99 unit lengths, respectively.

8. The web structure of claim 7, wherein:
a) a first three of the six long segments connect three points in said first set of points forming a hyperbolic triangle; and
b) a second three of the six long segments connect three points in said second set of points forming a hyperbolic triangle.

9. A web structure comprising a plurality of frames of claim 1.

10. A web structure comprising six frames of claim 1.

11. The web structure of claim 10, wherein the six frames are arranged in a manner that each frame touches the other five.

12. A structural element comprising a plurality of web structures of claim 10.

13. A structural element comprising a plurality of web structures of claim 1.

14. A web structure, comprising:
a) a generally octahedron-shaped frame including six vertices;
b) said frame comprising eight triangular surfaces; and
c) each said surface including at least one hyperbolic edge, and each of the six vertices being connected to each of the remaining vertices.

15. The web structure of claim 14, wherein:
a) each said surface includes at least two hyperbolic edges meeting at one of the vertices of the corresponding triangle.

16. The web structure of claim 15, wherein:
a) each said surface includes three hyperbolic edges.

17. A web structure comprising a plurality of frames of claim 14.

18. A web structure comprising a plurality of frames of claim 16.

19. An article of manufacture comprising the web structure of claim 14.

20. An article of manufacture comprising the web structure of claim 16.

21. A structural element comprising the web structure of claim 14.

22. A structural element comprising a plurality of web structures of claim 14.

23. A structural element comprising the web structure of claim 16.

24. A structural element comprising a plurality of web structures of claim 16.

25. A method of forming a web structure, comprising the steps of:
a) providing a plurality of generally octahedron-shaped frames;
b) each of the frames, comprising:
i. six points;
ii. a first set of a plurality of the points oriented in a first plane;
iii) a second set of a plurality of the points oriented in a second plane generally parallel to the first plane; and
iv) each of the points in the first set being connected to each of the points in the second set by hyperbolic segments;
c) arranging the frames in a manner that at least one point of one frame engages another frame.

26. The method of claim 25, wherein:
the step c) comprises arranging the frames in a manner that five points of one frame individually engage the other frames.

27. The method of claim 25, wherein:
the step c) comprises arranging the frames in a manner that five points of any one frame individually engage one point each of the other frames.

28. The method of claim 25, wherein:
the step a) comprises providing six frames.

29. The method of claim 28, wherein:

the step c) comprises arranging the six frames in a manner that five points of each frame individually engage one point each of the other frames.

30. A web structure, comprising:

a) a generally octahedron-shaped frame;

b) said frame comprising a first set of three points oriented in a first plane;

c) said frame comprising a second set of three points oriented in a second plane generally parallel to said first plane; and d) each of the six points in said first and second sets of points being connected to each of the remaining points by hyperbolic segments.

* * * * *